US007627481B1

(12) United States Patent
Kuo et al.

(10) Patent No.: US 7,627,481 B1
(45) Date of Patent: Dec. 1, 2009

(54) ADAPTING MASKING THRESHOLDS FOR ENCODING A LOW FREQUENCY TRANSIENT SIGNAL IN AUDIO DATA

(75) Inventors: Shyh-Shiaw Kuo, Cupertino, CA (US); Frank Baumgarte, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 814 days.

(21) Appl. No.: 11/110,331

(22) Filed: Apr. 19, 2005

(51) Int. Cl.
*G10L 19/00* (2006.01)

(52) U.S. Cl. ..... 704/500

(58) Field of Classification Search ..... 704/500–501
See application file for complete search history.

(56) References Cited

U.S. PATENT DOCUMENTS 5,394,473 A * 2/1995 Davidson ..... 704/200.1
5,502,789 A * 3/1996 Akagiri ..... 704/204
6,128,593 A 10/2000 Hu
6,195,633 B1 2/2001 Hu
6,240,379 B1 * 5/2001 Yin ..... 704/200.1
6,308,150 B1 * 10/2001 Neo et al. ..... 704/200.1
6,453,282 B1 * 9/2002 Hilpert et al. ..... 704/200.1
6,456,963 B1 * 9/2002 Araki ..... 704/200.1
6,772,111 B2 * 8/2004 Araki ..... 704/200.1
6,799,164 B1 * 9/2004 Araki ..... 704/500
2006/0161427 A1 * 7/2006 Ojala ..... 704/219

OTHER PUBLICATIONS

Chang et al. "On the Possibility of Only Using Long Windows in MPEG-2 AAC Coding". Lecture Notes on Computer Science, LNCS 253, 2002, pp. 663-670.*
Chang et al, "Using Only Long Windows in MPEG-2/4 AAC Encoding," Lecture Notes in Computer Science Lhrcs 3333, 2004, pp. 151-158.*
ISO/IEC FCD 14496-3 Subpart 4, May 15, 1998. In: Information Technology—Coding of Audiovisual Objects [CD-ROM], 4 files. (References on enclosed CD-ROM).
Grill, B. et al., ISO/IEC FCD 14496-3 Subpart 1, May 15, 1998. In: Information Technology—Very Low Bitrate Audio-Visual Coding [CD-ROM]. (References on enclosed CD-ROM).

* cited by examiner

*Primary Examiner*—James S Wozniak
(74) *Attorney, Agent, or Firm*—Hickman Palermo Truong & Becker LLP

(57) ABSTRACT

An improved audio coding technique encodes audio having a low frequency transient signal, using a long block, but with a set of adapted masking thresholds. Upon identifying an audio window that contains a low frequency transient signal, masking thresholds for the long block may be calculated as usual. A set of masking thresholds calculated for the 8 short blocks corresponding to the long block are calculated. The masking thresholds for low frequency critical bands are adapted based on the thresholds calculated for the short blocks, and the resulting adapted masking thresholds are used to encode the long block of audio data. The result is encoded audio with rich harmonic content and negligible coder noise resulting from the low frequency transient signal.

22 Claims, 3 Drawing Sheets

ADAPTING MASKING THRESHOLDS FOR ENCODING A LOW FREQUENCY TRANSIENT SIGNAL IN AUDIO DATA

FIELD OF THE INVENTION

The present invention relates generally to digital audio processing and, more specifically, to techniques for identifying low frequency transient signals in audio data and adapting a masking threshold for encoding audio data having a low frequency transient signal.

BACKGROUND OF THE INVENTION

Audio Coding

Audio coding, or audio compression, algorithms are used to obtain compact digital representations of high-fidelity (i.e., wideband) audio signals for the purpose of efficient transmission and/or storage. The central objective in audio coding is to represent the signal with a minimum number of bits while achieving transparent signal reproduction, i.e., while generating output audio which cannot be humanly distinguished from the original input, even by a sensitive listener.

Advanced Audio Coding ("AAC") is a wideband audio coding algorithm that exploits two primary coding strategies to dramatically reduce the amount of data needed to convey high-quality digital audio. AAC is referred to as a perceptual audio coder, or lossy coder, because it is based on a listener perceptual model, i.e., what a listener can actually hear, or perceive. Thus, signal components that are "perceptually irrelevant" and can be discarded without a perceived loss of audio quality are removed. Further, redundancies in the coded audio signal are eliminated. Hence, efficient audio compression is achieved by a variety of perceptual audio coding and data compression tools, which are combined in the MPEG-4 AAC specification. The MPEG-4 AAC standard incorporates MPEG-2 AAC, forming the basis of the MPEG-4 audio compression technology for data rates above 32 kbps per channel. Additional tools increase the effectiveness of AAC at lower bit rates, and add scalability or error resilience characteristics. These additional tools extend AAC into its MPEG-4 incarnation (ISO/IEC 14496-3, Subpart 4).

Audio Coding Masking

Simultaneous Masking is a frequency domain phenomenon where a low level signal, e.g., a smallband noise (the "maskee") can be made inaudible by a simultaneously occurring stronger signal (the "masker"). A masking threshold can be measured below which any signal, including distortion or noise, will not be audible. The masking threshold depends on the sound pressure level (SPL) and the frequency of the masker, and on the characteristics of the masker and maskee. If the source signal includes many simultaneous maskers, a global masking threshold can be computed that describes the threshold of just noticeable distortions as a function of frequency. The most common way of calculating the global masking threshold is based on the high resolution short term amplitude spectrum of the audio or speech signal.

Coding audio based on the psychoacoustic model only encodes audio signals above a masking threshold, block by block of audio. Therefore, if distortion (typically referred to as quantization noise), which is inherent to an amplitude quantization process, is under the masking threshold, a typical human cannot hear the noise. A sound quality target is based on a subjective perceptual quality scale (e.g., from 0-5, with 5 being best quality). From an audio quality target on this perceptual quality scale, a noise profile, i.e., an offset from the applicable masking threshold, is determinable. This noise profile represents the level at which quantization noise can be masked, while achieving the desired quality target. From the noise profile, an appropriate coding quantization step is determinable.

Audio Coding Artifacts

A typical audio coding process transforms a time-based waveform (e.g., represented as pulse code modulation ("PCM") samples) into the frequency domain, using a Fourier-related transform function (e.g., Fast Fourier Transform). With AAC coding, an MDCT (modified discrete cosine transform) function is typically used to transform audio data from the time domain to the frequency domain. In the frequency domain, the data is analyzed to compute the masking threshold and associated quantization step coefficients to use in efficiently encoding the data. The audio bit stream is transferred to a decoder, which reconstructs the audio signal represented by the audio data. This reconstruction occurs first in the frequency domain, and then is transformed back into the time domain via an inverse transform function (e.g., Inverse Fast Fourier Transform). As a result of the audio reconstruction process, primarily the inverse transformation step, quantization noise is spread from its associated signal origin (e.g., a transient signal). At some points in the time domain, the spread of the noise produces noise above the level of the original waveform. This noise spread produces what is commonly referred to as a pre-echo artifact which, if above the masking threshold, may be audible to a human.

In the time domain, each sample represents the full signal spectrum at points in time. In the frequency domain, each coefficient represents the frequency band of the signal at points in time. Hence, the time domain enables a higher time resolution than the frequency domain, and the frequency domain enables a higher frequency resolution than the time domain. Consequently, distortion created in the frequency domain by changing a coefficient is spread in time over several samples in the time domain. Improperly encoded transient signals will result in pre-echo artifacts in which quantization noise from one transform block is spread in time and precedes the transient by more than a millisecond or so and therefore cannot be masked by the transient itself. Block switching between long transform blocks (2048 PCM samples for AAC, due to overlap) and short transform blocks (256 PCM samples for AAC, due to overlap) is typically used in AAC to resolve this problem. Long blocks provide great coding gain and high frequency resolution, and are most suitable for signals whose spectrum remain stationary, or vary slowly in time relative to the block length. Short blocks, on the other hand, are usually not desirable due to its low coding gain and low frequency resolution. However, short blocks provide better time resolution and, therefore, are more effective for encoding non-stationary or transient signals in order to prevent pre-echo artifacts.

A typical approach to handling pre-echo artifacts due to transient signals is to process an entire long block of audio data (e.g., 2048 samples for AAC) in eight separate short blocks (e.g., of 256 samples). Hence, the spread of the noise is limited to the duration of the short block containing the transient and the noise does not spread as far in time. Consequently, the energy from the transient signal is more likely to mask the spread noise, that is, the pre-echo artifact. However, due to the high frequency resolution needed to encode rich harmonic audio content, and the relatively limited frequency resolution enabled through use of short blocks, limiting the spread of and thus masking the noise through use of short blocks is at the expense of accurately encoding rich audio content in relation to its source.

Coding Low Frequency Transient Signals

Normally, only high frequency transient signals are of concern with respect to pre-echo artifacts, and a typical block switching mechanism would switch to short block mode whenever a high frequency transient is detected. Low frequency transients normally do not pose a pre-echo problem due to their slow varying nature in the time domain. However, low frequency transients are still a concern because the relatively higher energy of such transients requires higher quantization steps for encoding. Higher quantization steps induce, in the frequency domain, quantization noise across an entire block due to the coarser time resolution in the frequency domain. Hence, for a low energy signal quantized with a large quantization step, the induced noise is not masked by the signal for the entire time period over which the noise is spread.

Further, with a strong energy fluctuation at low frequencies, it is implied that the fluctuation is fairly slow. That means that the masking threshold can track the signal energy level in time without a strong post-masking effect. Since the masking thresholds derived from long blocks do not have sufficient time resolution to track the energy fluctuation, the estimated masking threshold will be too high in the valleys of the energy curve. Thus, the coder distortions may become audible in these valleys. From this point of view, instead of pre-echo artifacts, the mechanism that creates audible distortions may be referred to as a "noise floor" which is audible in the valleys.

A naïve approach to handling low frequency transient signals is to switch to short block mode when encoding windows of audio data that contain low frequency transients. However, short block mode does not enable the frequency resolution enabled by long block mode, such as the frequency resolution needed to accurately encode harmonic, tonal signals (e.g., harpsichord, violin) to a high level of perceptual quality. Therefore, long block encoding is typically used for low frequency transient signals, possibly at the expense of some audible distortion. However, there are some audio tracks that have such severe low frequency attacks that will result in significant pre-echo or other artifacts if short block mode is not used. Unfortunately, switching to short block mode for low frequency attacks may result in audible artifacts (e.g., less perceptual quality) for signals that also have rich harmonic contents, such as some techno tracks or harpsichord tracks. This is because these signals require high frequency resolution to encode these harmonics and only long blocks can provide that level of frequency resolution.

Based on the foregoing, there is room for improvement in audio coding techniques, especially in the context of handling low frequency transient signals.

The techniques described in this section are techniques that could be pursued, but not necessarily techniques that have been previously conceived or pursued. Therefore, unless otherwise indicated, it should not be assumed that any of the techniques described in this section qualify as prior art merely by virtue of their inclusion in this section.

SUMMARY OF EMBODIMENTS OF THE INVENTION

An improved audio coding technique encodes audio having a low frequency transient signal using a long block, but with a set of adapted masking thresholds. Upon identifying an audio window (which typically corresponds to a long block) that contains a low frequency transient signal, in one embodiment of the invention, masking thresholds for the long block are calculated as usual. However, in addition, a set of masking thresholds calculated for the 8 short blocks corresponding to the long block are also calculated. The masking thresholds for the low frequency critical bands are adapted based on the thresholds calculated for the short blocks, and the resulting adapted masking thresholds are used to encode the long block of audio data. In one embodiment of the invention, the adapted masking threshold used to encode a particular critical band or bands of the long block of audio data is a masking threshold between the corresponding masking threshold computed for the long block and the minimum masking threshold from the set calculated for the short blocks.

Consequently, the advantages of high frequency resolution provided by use of long blocks in the frequency domain are obtained, for example, for rich harmonic audio content. Further, the advantages of high time resolution provided by use of short blocks in the time domain are obtained, thereby minimizing the spread of coder quantization noise induced into the audio through the process of analyzing, transforming and encoding the low frequency transient signal. The result is encoded audio with rich harmonic content and limited, i.e., negligible to the human ear, pre-echo and other distortion artifacts.

In one embodiment of the invention, the described technique is applied to MPEG-4 AAC coding processes (e.g., as specified in ISO/IEC 14496-3, Subpart 4, et seq.).

BRIEF DESCRIPTION OF THE DRAWINGS

Embodiments of the present invention are illustrated by way of example, and not by way of limitation, in the figures of the accompanying drawings and in which like reference numerals refer to similar elements and in which.

DETAILED DESCRIPTION OF EMBODIMENTS OF THE INVENTION

In the following description, for the purposes of explanation, numerous specific details are set forth in order to provide a thorough understanding of embodiments of the present invention. It will be apparent, however, that embodiments of the present invention may be practiced without these specific details. In other instances, well-known structures and devices are shown in block diagram form in order to avoid unnecessarily obscuring embodiments of the present invention.

Functional Overview of Embodiments of the Invention

One unfortunate result of audio encoding processes is the spread of quantization noise from the signal origin of the noise (e.g., a transient signal). Sometimes the spread of the quantization noise produces distortion (i.e., a pre-echo artifact) above the level of the original waveform. If the distortion is above the masking threshold, the distortion may be audible to a human.

An improved audio coding technique encodes audio having a low frequency transient signal using a long block, but with a set of adapted masking thresholds. Upon identifying an audio window that contains a low frequency transient signal, in one embodiment of the invention, masking thresholds for the long block are calculated as usual. However, in addition, a set of masking thresholds calculated for the 8 short blocks corresponding to the long block are also calculated. The masking thresholds for the low frequency critical bands are adapted based on the thresholds calculated for the short blocks, and the resulting adapted masking thresholds are used to encode the long block of audio data.

A Method for Adapting a Masking Threshold for Use in Encoding Audio Having a Low Frequency Transient Signal A "window" of audio data refers to a portion of an audio stream or of an audio file, for non-limiting examples, an "*.mp4", "*.m4a", "*.m4p", or similar file. In this description, a window of audio refers to the unit of audio being transformed or otherwise processed or encoded at any given time, unless otherwise indicated. In practice, a window of audio is often congruent with what is referred to as a block of audio. For example, a block of audio commonly refers to 1024 PCM samples. With MPEG-4 AAC, a "frame" of audio typically comprises 1024 PCM samples, however, a transform window corresponds to a "long block" which comprises 2048 PCM samples, due to the MDCT overlap. An MPEG-4 AAC "short block" comprises 256 PCM samples, again due to the MDCT overlap.

Figure 1:
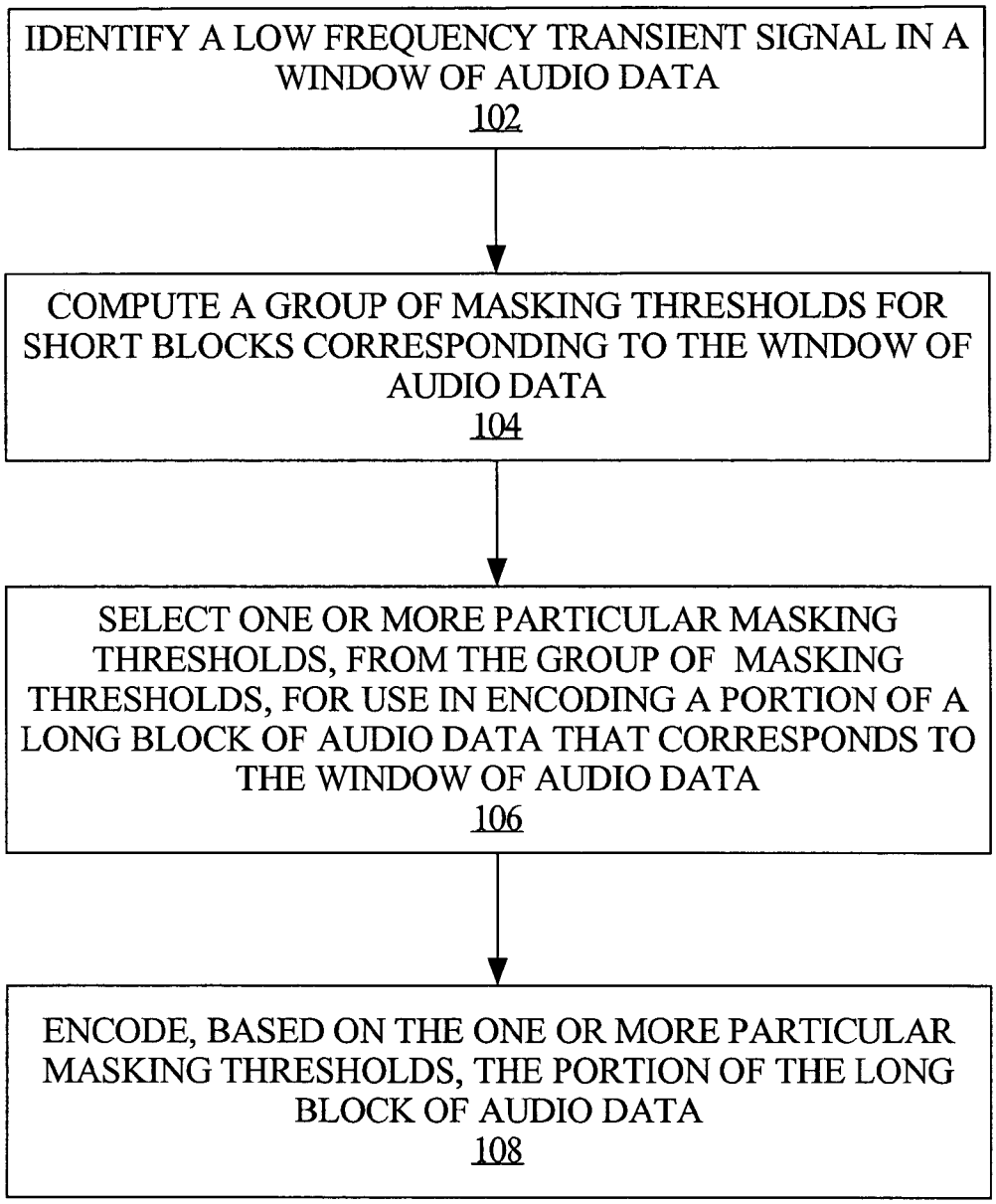
FIG. 1 is a flow diagram that illustrates a method for adaptively selecting a masking threshold for use in encoding a portion of audio having a low frequency transient signal, according to an embodiment of the invention.

FIG. 1 is a flow diagram that illustrates a method for adaptively selecting a masking threshold for use in encoding a portion of audio having a low frequency transient signal, according to an embodiment of the invention. The method illustrated in FIG. 1 may be performed by execution of one or more sequences of instructions by or on one or more electronic computing devices, for non-limiting examples, a computer system like computer system 300 of FIG. 3, a portable electronic device such as a digital music player, personal digital assistant, and the like. Further, the method may be integrated into other audio or multimedia applications that execute on an electronic computing device, such as media authoring and playback applications.

In one embodiment of the invention, the method of FIG. 1 is performed in the context of encoding audio in accordance with the MPEG-4 AAC specification. However, the context in which the following method is performed may vary from implementation to implementation and, therefore, is not limited to use with MPEG-4 AAC encoding schemes.

Identify a Low Frequency Transient Signal in Audio Data

At block 102, a low frequency transient signal is identified in a window of audio data. In MPEG-4 AAC implementations, the window referred to at block 102 would typically correspond to a block of audio comprising 2048 PCM samples. The manner in which a low frequency transient signal is identified at block 102 may vary from implementation to implementation. One non-limiting technique for identifying a low frequency transient signal in audio data is described in FIG. 2 and the associated description.

In one embodiment of the invention, a low frequency transient signal is a transient signal, however defined or determined, with a frequency that is near or below 5 kHz. The threshold that defines a "low frequency" signal may vary from implementation to implementation. Empirically, a range around 5 kHz, e.g., a range of approximately 4 kHz to 6 kHz, has been found to work well relative to the simultaneous masking phenomenon and humans' actual acoustic perceptual abilities.

Compute a Group of Masking Thresholds for Short Blocks

In response to identifying a low frequency transient signal in the window of audio data, at block 104, compute a group of masking thresholds for short blocks that correspond to the window of audio data. As mentioned, with MPEG-4 AAC, eight (8) short blocks correspond to a single long block, and each short block comprises 256 PCM overlapped samples. Techniques for computing masking thresholds for each of the short blocks are well-known and can use conventional algorithms, typically in the frequency domain. In one embodiment of the invention, the group of masking thresholds consists of separate masking thresholds for each of the short blocks.

A masking threshold is typically represented as a relationship between frequency and some characterization of energy, such as sound pressure level (in decibels or a linear scale, depending on the coder). Coders typically compute a masking threshold for each of multiple frequency bands. For example, a coder may compute a masking threshold for each critical band. One can think of a critical band as a frequency selective "channel" of psychoacoustic processing, where only noise falling within the critical bandwidth can contribute to the masking of a narrow band signal. The mammalian auditory system consists of a whole series of critical bands, each filtering out a specific portion of the audio spectrum. The ranges of frequencies associated with respective critical bands are coder-specific and, therefore, vary from coder to coder.

In practice, processing a typical short block generates a masking threshold for each coder-specific critical band for the short block. Hence, in one embodiment of the invention, the group of masking thresholds computed at block 104 consists of separate masking thresholds for each critical band of each of the short blocks.

Select Particular Masking Threshold(s) for Use in Encoding the Portion of the Long Block At block 106, one or more particular masking thresholds are selected, from the group of masking thresholds computed for the short blocks at block 104, for use in encoding a portion of a long block of audio data that corresponds to the window of audio data. In one embodiment of the invention, the portion of the long block for which the one or more particular masking thresholds are selected is a critical band associated with the long block. In other words, for a given critical band for the long block, one or more masking thresholds are selected for a corresponding frequency band from one of the short blocks.

Due to a potential difference in critical bands for a long block and for corresponding short blocks, one or more critical bands for a short block may need to be mapped to a corresponding one or more critical bands for the long block. For example, a first critical band for a long block may be from 0 to 100 Hz and a second critical band may be from 100 Hz to 200 Hz; whereas a first critical band for a short block may be from 0 to 200 Hz. Thus, the first critical band for the short block maps to the first and second critical bands for the long block. Furthermore, critical bands from short and long blocks may not map in equivalent bands. For example, a first critical band for a long block may be from 0 to 100 Hz, a second critical band may be from 100 Hz to 300 Hz, and a third critical band may be from 300 Hz to 500 Hz; whereas a first critical band for a short block may be from 0 to 200 Hz and a second critical band from 200 Hz to 400 Hz. Thus, the second critical band for the long block maps to portions of the first and second critical bands for the short block. In such a scenario, the masking threshold selected for use in encoding the second critical band for the long block is proportioned from the masking thresholds for the first and second critical bands for the short blocks.

In one embodiment of the invention, the one or more particular masking thresholds selected for use in encoding the long block are the one or more minimum masking thresholds, from the group of masking thresholds computed for the short blocks, that correspond to the portion of the long block. With AAC, the quantization step used to encode audio can vary only per different scalefactor band (i.e., can vary from scalefactor band to scalefactor band, but not within a scalefactor band), where the scalefactor bands are defined in the MPEG-4 AAC standard specifications. Thus, for a given critical band (e.g., a scalefactor band) for the long block, the minimum masking threshold(s) for use in encoding that critical band is identified by identifying the masking threshold(s), from corresponding critical band(s) for each of the short blocks, that corresponds to the smallest energy level.

Encode the Portion of the Long Block

At block 108, the portion of the long block of audio data, e.g., a critical band, is encoded based on the one or more particular masking thresholds selected at block 106. That is, the quantization step actually used to encode the portion of the long block is derived from the one or more particular masking thresholds. In one embodiment of the invention, the portion of the long block is encoded according to and in compliance with the MPEG-4 AAC standard specifications.

Using a lesser, short block based masking threshold, rather than a greater, long block based masking threshold, results in a smaller quantization step for encoding the audio portion. Hence, the level of noise introduced by the coding process is lower and, therefore, more likely to be below the masking threshold and masked by the original signal energy.

In one embodiment of the invention, the one or more particular masking thresholds selected at block 106 are not used directly to encode the long block. Rather, in addition to computing the masking thresholds for each of the short blocks, masking thresholds are also computed for the long block that corresponds to the window of audio. Then, the masking threshold to use to encode a given portion of the long block is derived from corresponding masking thresholds for the long block and the particular short block.

For example, the final masking threshold used to encode the portion of the long block, e.g., a critical band of the long block, is somewhere between the masking threshold computed for that portion of the long block and the masking threshold(s) selected from the corresponding portion(s) of the short block. For a non-limiting example, if the masking threshold for the first critical band for the long block is 4 dB, and the masking threshold for a corresponding critical band for the particular short block is 1 dB (e.g., the minimum masking threshold for that critical band, selected from all of the short blocks), then the final masking threshold used to encode the first critical band for the long bock may be 2 dB [e.g., (1 dB+(4 dB−1 dB)/3)=2 dB].

The foregoing example is merely an example, with the point being that the final masking threshold used to encode the portion is not the selected short block masking threshold because that would reduce the pre-echo artifact (or other quantization noise due to the low frequency transient) but would use too many bits for encoding (i.e., long block mode uses fewer bits than short block mode). Also, the final masking threshold used to encode the portion is not the long block masking threshold because that would use minimum bits for encoding but would not eliminate or reduce the pre-echo artifact or other quantization noise, as desired. Hence, some portion of the difference between the long block masking threshold and the selected short block masking threshold, above the selected short block masking threshold, is used to determine the corresponding quantization step for encoding the portion of the long block.

Figure 2:
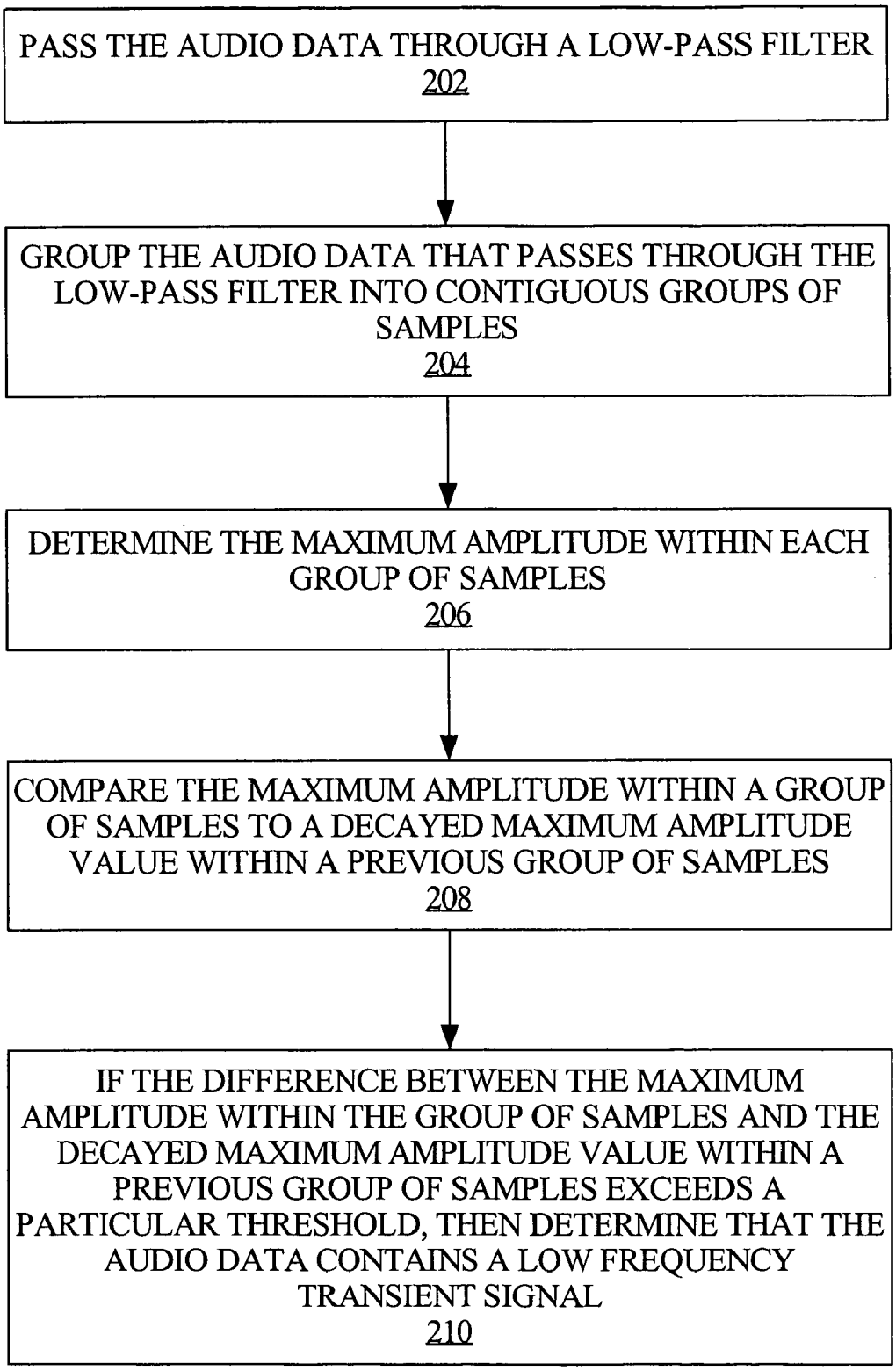
FIG. 2 is a flow diagram that illustrates a method for identifying a low frequency transient signal in audio data, according to an embodiment of the invention.

The method depicted in FIG. 2, when executed, attempts to balance opposing concerns, e.g., (a) tonal quality versus masking or eliminating pre-echo and other low frequency transient-based artifacts, and (b) bit usage to encode a block versus masking pre-echo and other low frequency transient-based artifacts. Further, use of the method with signals that are stationary, but perceptually transient, avoids tonal smearing and provides perceptually high quality encoding at necessary frequencies. For example, coding of a mathematically stable waveform which, depending on the summation and phase of the waveform's component signals, appears to the human auditory system to contain transients (i.e., perceptible fluctuations in energy) can benefit from the adaptive masking threshold techniques described herein.

A Method for Identifying a Low Frequency Transient Signal in Audio Data

FIG. 2 is a flow diagram that illustrates a method for identifying a low frequency transient signal in audio data, according to an embodiment of the invention. The method illustrated in FIG. 2 may be implemented for performance of the action associated with block 102 of FIG. 1. The method illustrated in FIG. 2 may be performed by execution of one or more sequences of instructions by or on one or more electronic computing devices, for non-limiting examples, a computer system like computer system 300 of FIG. 3, a portable electronic device such as a digital music player, personal digital assistant, and the like. Further, the method may be integrated into other audio or multimedia applications that execute on an electronic computing device, such as media authoring and playback applications.

In one embodiment of the invention, the method of FIG. 2 is performed in the context of encoding audio in accordance with the MPEG-4 AAC specification. However, the context in which the following method is performed may vary from implementation to implementation and, therefore, is not limited to use with MPEG-4 AAC encoding schemes.

At block 202, the window of audio data is passed through a low-pass filter. For example, because the adaptive masking threshold technique described herein is concerned with low frequency transient signals, the audio may be passed through a 5 kHz low-pass filter, through which only frequencies substantially equal to or less than 5 kHz pass.

At block 204, the audio data that passes through the low-pass filter is grouped into some number of contiguous groups of samples. For a non-limiting example, the audio data may be grouped in eight (8) groups of 128 PCM samples each, which is equivalent to a common block size of 1024 non-overlapping PCM samples, where each group represents a range of time in the time domain. At block 206, the maximum amplitude within each group of samples is determined.

At block 208, the maximum amplitude within a group of samples is compared to a maximum amplitude within a previous group of samples. In one embodiment of the invention, the maximum amplitude within each of the groups of samples is compared to the maximum amplitude within the adjacent previous group of samples. In one embodiment of the invention, the maximum amplitude within a group of samples is compared to a decayed maximum amplitude value within the adjacent previous group of samples. Thus, absolute maximums from adjacent groups are not compared, but rather one or both of the values being compared may be a value decayed from the absolute maximum. The decayed maximum amplitude value may be derived from an envelope follower, for example, with which the rate of decay is based on the psychoacoustic model.

At block 210, if the ratio of the maximum amplitude within the group of samples and the maximum amplitude within the previous group of samples exceeds a threshold value, then determine that the window of audio contains a low frequency transient signal.

In one embodiment of the invention, the low frequency transient identification process includes a second level of analysis. While comparing each pair of sample groups, i.e., comparing the maximum amplitude within a group of samples to the maximum amplitude within the adjacent previous group of samples (e.g., at block 208), the maximum amplitude of each respective comparison-pair is stored, such as in an array. Further, the maximum amplitude of each respective comparison-pair is compared with the maximum amplitude of the adjacent previous comparison-pair. Similar to block 210, if the ratio of a maximum amplitude of a comparison-pair and the maximum amplitude of the adjacent previous comparison-pair exceeds a threshold value, then it is determined that the window of audio contains a low frequency transient signal.

In one embodiment of the invention, the two levels of maximum amplitude analysis are effectively summed together, with the summed results indicating whether or not any of the blocks of samples contains a low frequency transient signal. This technique is more likely than the one-level analysis to detect a significant energy fluctuation that occurs over a longer period of time, whose encoding may cause perceptible noise.

Regardless of the process used for identifying a low frequency transient signal, once such a signal is identified, the coding process adapts the masking threshold for use in encoding the long block of audio data based on the short block masking thresholds, as described herein.

Hardware Overview

Figure 3:
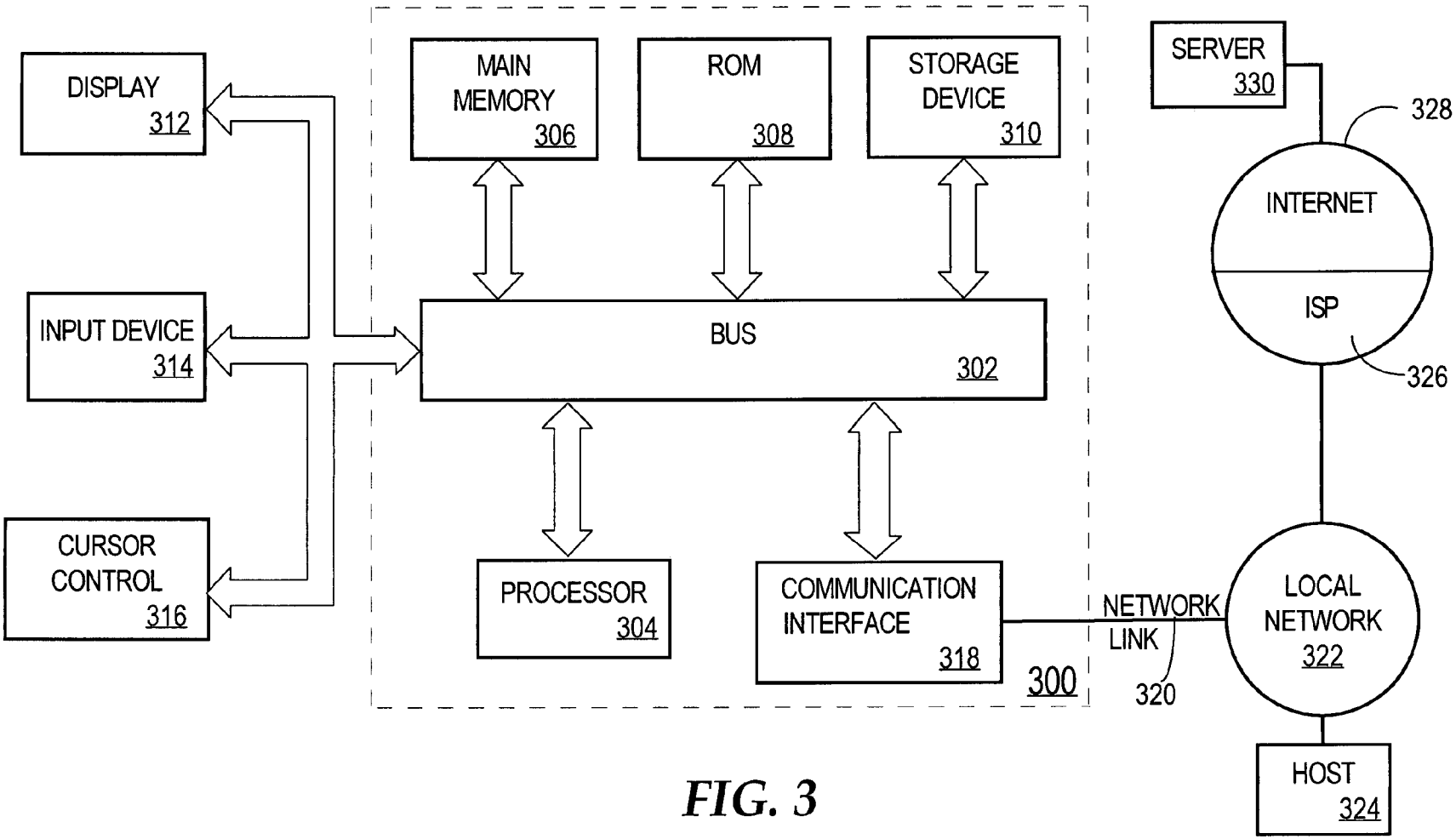
FIG. 3 is a block diagram that illustrates a computer system upon which an embodiment of the invention may be implemented.

FIG. 3 is a block diagram that illustrates a computer system 300 upon which an embodiment of the invention may be implemented. A computer system as illustrated in FIG. 3 is but one possible system on which embodiments of the invention may be implemented and practiced. For example, embodiments of the invention may be implemented on any suitably configured device, such as a handheld or otherwise portable device, a desktop device, a set-top device, a networked device, and the like, configured for containing and/or playing audio. Hence, all of the components that are illustrated and described in reference to FIG. 3 are not necessary for implementing embodiments of the invention.

Computer system 300 includes a bus 302 or other communication mechanism for communicating information, and a processor 304 coupled with bus 302 for processing information. Computer system 300 also includes a main memory 306, such as a random access memory (RAM) or other dynamic storage device, coupled to bus 302 for storing information and instructions to be executed by processor 304. Main memory 306 also may be used for storing temporary variables or other intermediate information during execution of instructions to be executed by processor 304. Computer system 300 further includes a read only memory (ROM) 308 or other static storage device coupled to bus 302 for storing static information and instructions for processor 304. A storage device 310, such as a magnetic disk or optical disk, is provided and coupled to bus 302 for storing information and instructions.

Computer system 300 may be coupled via bus 302 to a display 312, such as a cathode ray tube (CRT), for displaying information to a computer user. An input device 314, including alphanumeric and other keys, is coupled to bus 302 for communicating information and command selections to processor 304. Another type of user input device is cursor control 316, such as a mouse, a trackball, or cursor direction keys for communicating direction information and command selections to processor 304 and for controlling cursor movement on display 312. This input device typically has two degrees of freedom in two axes, a first axis (e.g., x) and a second axis (e.g., y), that allows the device to specify positions in a plane.

The invention is related to the use of computer system 300 for implementing the techniques described herein. According to one embodiment of the invention, those techniques are performed by computer system 300 in response to processor 304 executing one or more sequences of one or more instructions contained in main memory 306. Such instructions may be read into main memory 306 from another machine-readable medium, such as storage device 310. Execution of the sequences of instructions contained in main memory 306 causes processor 304 to perform the process steps described herein. In alternative embodiments, hard-wired circuitry may be used in place of or in combination with software instructions to implement the invention. Thus, embodiments of the invention are not limited to any specific combination of hardware circuitry and software.

The term "machine-readable medium" as used herein refers to any medium that participates in providing data that causes a machine to operation in a specific fashion. In an embodiment implemented using computer system 300, various machine-readable media are involved, for example, in providing instructions to processor 304 for execution. Such a medium may take many forms, including but not limited to, non-volatile media, volatile media, and transmission media. Non-volatile media includes, for example, optical or magnetic disks, such as storage device 310. Volatile media includes dynamic memory, such as main memory 306. Transmission media includes coaxial cables, copper wire and fiber optics, including the wires that comprise bus 302. Transmission media can also take the form of acoustic or light waves, such as those generated during radio-wave and infra-red data communications.

Common forms of machine-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, and EPROM, a FLASH-EPROM, any other memory chip or cartridge, a carrier wave as described hereinafter, or any other medium from which a computer can read.

Various forms of machine-readable media may be involved in carrying one or more sequences of one or more instructions to processor 304 for execution. For example, the instructions may initially be carried on a magnetic disk of a remote computer. The remote computer can load the instructions into its dynamic memory and send the instructions over a telephone line using a modem. A modem local to computer system 300 can receive the data on the telephone line and use an infra-red transmitter to convert the data to an infra-red signal. An infra-red detector can receive the data carried in the infra-red signal and appropriate circuitry can place the data on bus 302. Bus 302 carries the data to main memory 306, from which processor 304 retrieves and executes the instructions. The instructions received by main memory 306 may optionally be stored on storage device 310 either before or after execution by processor 304.

Computer system 300 also includes a communication interface 318 coupled to bus 302. Communication interface 318 provides a two-way data communication coupling to a network link 320 that is connected to a local network 322. For example, communication interface 318 may be an integrated services digital network (ISDN) card or a modem to provide a data communication connection to a corresponding type of telephone line. As another example, communication interface 318 may be a local area network (LAN) card to provide a data communication connection to a compatible LAN. Wireless links may also be implemented. In any such implementation, communication interface 318 sends and receives electrical, electromagnetic or optical signals that carry digital data streams representing various types of information.

Network link 320 typically provides data communication through one or more networks to other data devices. For example, network link 320 may provide a connection through local network 322 to a host computer 324 or to data equipment operated by an Internet Service Provider (ISP) 326. ISP 326 in turn provides data communication services through the world wide packet data communication network now commonly referred to as the "Internet" 328. Local network 322 and Internet 328 both use electrical, electromagnetic or optical signals that carry digital data streams. The signals through the various networks and the signals on network link 320 and through communication interface 318, which carry the digital data to and from computer system 300, are exemplary forms of carrier waves transporting the information.

Computer system 300 can send messages and receive data, including program code, through the network(s), network link 320 and communication interface 318. In the Internet example, a server 330 might transmit a requested code for an application program through Internet 328, ISP 326, local network 322 and communication interface 318. The received code may be executed by processor 304 as it is received, and/or stored in storage device 310, or other non-volatile storage for later execution. In this manner, computer system 300 may obtain application code in the form of a carrier wave.

Extensions and Alternatives

Alternative embodiments of the invention are described throughout the foregoing description, and in locations that best facilitate understanding the context of such embodiments. Furthermore, the invention has been described with reference to specific embodiments thereof. It will, however, be evident that various modifications and changes may be made thereto without departing from the broader spirit and scope of the invention. Therefore, the specification and drawings are, accordingly, to be regarded in an illustrative rather than a restrictive sense.

In addition, in this description certain process steps are set forth in a particular order, and alphabetic and alphanumeric labels may be used to identify certain steps. Unless specifically stated in the description, embodiments of the invention are not necessarily limited to any particular order of carrying out such steps. In particular, the labels are used merely for convenient identification of steps, and are not intended to specify or require a particular order of carrying out such steps.

What is claimed is:

1. A volatile or non-volatile machine-readable storage medium storing one or more sequences of instructions which, when executed by one or more processors, cause the one or more processors to perform:

in response to determining that a first window of audio data does not contain a low frequency transient signal, computing a first group of masking thresholds for a first long block that corresponds to the first window of audio data; and based on said first group of masking thresholds, encoding said first long block of audio data;

in response to identifying a low frequency transient signal in a second window of audio data, computing a second group of masking thresholds for short blocks corresponding to the second window of audio data;

selecting one or more particular masking thresholds, from the second group of masking thresholds, for use in encoding a second long block of audio data that corresponds to the second window of audio data; and encoding, based on the one or more particular masking thresholds, the second long block of audio data.

2. The volatile or non-volatile machine-readable storage medium of claim 1, wherein the one or more sequences of instructions which, when executed by one or more processors, cause the one or more processors to perform:

computing a third group of masking thresholds for the second long block that corresponds to the second window of audio data;

encoding the second long block of audio data using a quantization step that is based on a masking threshold between the one or more particular masking thresholds and a masking threshold from the third group of masking thresholds.

3. The volatile or non-volatile machine-readable storage medium of claim 1, wherein the one or more particular masking thresholds correspond to one or more low frequency critical bands of the second long block of audio data.

4. The machine-readable storage medium of claim 1, wherein the one or more particular masking thresholds correspond to a particular short block of the short blocks, and wherein each critical band associated with the particular short block corresponds to a particular masking threshold, and wherein the one or more sequences of instructions which, when executed by one or more processors, cause the one or more processors to perform:

mapping a critical band associated with the second long block to one or more particular critical bands associated with the particular short block;

wherein selecting the one or more particular masking thresholds for use in encoding the second long block includes selecting one or more particular masking thresholds that correspond to the one or more particular critical bands, which map to the critical band associated with the second long block, that are associated with the particular short block; and encoding, based on the one or more particular masking thresholds that correspond to the one or more particular critical bands associated with the particular short block, the particular critical band associated with the second long block.

5. The volatile or non-volatile machine-readable storage medium of claim 1, wherein the one or more sequences of instructions which, when executed by one or more processors, cause the one or more processors to perform:

wherein selecting the one or more particular masking thresholds for use in encoding the second long block includes selecting one or more minimum masking thresholds associated with the second long block, from the group of masking thresholds, for use in encoding the second long block of audio data.

6. The volatile or non-volatile machine-readable storage medium of claim 1, wherein the one or more sequences of instructions which, when executed by one or more processors, cause the one or more processors to perform:

identifying the low frequency transient signal in the window of audio data.

7. The volatile or non-volatile machine-readable storage medium of claim 6, wherein a low frequency transient signal is a signal having a frequency that is substantially at or below a threshold frequency value, wherein the threshold frequency value is within a range from 4 kHz to 6 kHz.

8. The volatile or non-volatile machine-readable storage medium of claim 6, wherein the one or more sequences of instructions which, when executed by one or more processors, cause the one or more processors to perform identifying the low frequency transient signal by performing:

passing the audio data through a low pass filter;

grouping the audio data that passes through the low pass filter into contiguous groups of samples;

determining the maximum amplitude within each group of samples;

comparing the maximum amplitude within a group of samples to a decayed maximum amplitude value within an adjacent previous group of samples; and if the ratio of the maximum amplitude within the group of samples and the decayed maximum amplitude value within the adjacent previous group of samples exceeds a particular threshold value, then determining that the audio data contains a low frequency transient signal.

9. The volatile or non-volatile machine-readable storage medium of claim 1, wherein the one or more sequences of instructions which, when executed by one or more processors, cause the one or more processors to perform:

encoding, based on the one or more particular masking thresholds and in compliance with MPEG-4 Advanced Audio Coding standard specifications, the second long block of audio data.

10. The volatile or non-volatile machine-readable storage medium of claim 1, wherein the group of masking thresholds comprises respective masking thresholds for each critical band of each of the short blocks corresponding to the window of audio data.

11. A computer-implemented method for determining a masking threshold for use in encoding audio data, the method comprising:

in response to determining that a first window of audio data does not contain a low frequency transient signal, computing a first group of masking thresholds for a first long block that corresponds to the first window of audio data; and based on said first group of masking thresholds, encoding said first long block of audio data;

in response to identifying a low frequency transient signal in a second window of audio data, computing a second group of masking thresholds for short blocks corresponding to the second window of audio data;

selecting one or more particular masking thresholds, from the second group of masking thresholds, for use in encoding a second long block of audio data that corresponds to the second window of audio data;

encoding, based on the one or more particular masking thresholds, the second long block of audio data;

wherein the computer-implemented method is performed by one or more computing devices.

12. The computer-implemented method of claim 11, further comprising:

computing a third group of masking thresholds for the second long block that corresponds to the second window of audio data;

encoding the second long block of audio data using a quantization step that is based on a masking threshold between the one or more particular masking thresholds and a masking threshold from the third group of masking thresholds.

13. The computer-implemented method of claim 11, wherein the one or more particular masking thresholds correspond to one or more low frequency critical bands of the second long block of audio data.

14. The computer-implemented method of claim 11, wherein the one or more particular masking thresholds correspond to a particular short block of the short blocks, and wherein each critical band associated with the particular short block corresponds to a particular masking threshold, the method further comprising:

mapping a critical band associated with the second long block to one or more particular critical bands associated with the particular short block;

wherein selecting the one or more particular masking thresholds for use in encoding the second long block includes selecting one or more particular masking thresholds that correspond to the one or more particular critical bands, which map to the critical band associated with the second long block, that are associated with the particular short block; and encoding, based on the one or more particular masking thresholds that correspond to the one or more particular critical bands associated with the particular short block, the particular critical band associated with the second long block.

15. The computer-implemented method of claim 11:

wherein selecting the one or more particular masking thresholds for use in encoding the second long block includes selecting one or more minimum masking thresholds associated with the second long block, from the group of masking thresholds, for use in encoding the second long block of audio data.

16. The computer-implemented method of claim 11, further comprising:

identifying the low frequency transient signal in the window of audio data.

17. The computer-implemented method of claim 16, wherein a low frequency transient signal is a signal having a frequency that is substantially at or below a threshold frequency value, wherein the threshold frequency value is within a range from 4 kHz to 6 kHz.

18. The computer-implemented method of claim 16, wherein identifying the low frequency transient signal comprises:

passing the audio data through a low pass filter;

grouping the audio data that passes through the low pass filter into contiguous groups of samples;

determining the maximum amplitude within each group of samples;

comparing the maximum amplitude within a group of samples to a decayed maximum amplitude value within an adjacent previous group of samples; and if the ratio of the maximum amplitude within the group of samples and the decayed maximum amplitude value within the adjacent previous group of samples exceeds a particular threshold value, then determining that the audio data contains a low frequency transient signal.

19. The computer-implemented method of claim 11, further comprising:

encoding, based on the one or more particular masking thresholds and in compliance with MPEG-4 Advanced Audio Coding standard specifications, the second long block of audio data.

20. The computer-implemented method of claim 11, wherein the group of masking thresholds comprises respective masking thresholds for each critical band of each of the short blocks corresponding to the window of audio data.

21. A volatile or non-volatile machine-readable storage medium storing one or more sequences of instructions which, when executed by one or more processors, cause the one or more processors to perform:

in response to determining that a first window of audio data does not contain a low frequency transient signal, computing a first group of masking thresholds for a first long block that corresponds to the first window of audio data; and based on said first group of masking thresholds, encoding said first long block of audio data;

in response to identifying a low frequency transient signal in a second window of digital audio samples, computing a second group of masking thresholds for a second long block that corresponds to the second window of audio samples;

computing a third group of masking thresholds for short blocks corresponding to the second window of audio samples;

selecting a final masking threshold that is between (a) one or more particular masking thresholds from the third group of masking thresholds and (b) one or more particular masking thresholds from the second group of masking thresholds; and based on said final masking threshold, encoding by a coder the second long block that corresponds to the window of audio samples.

22. A computer-implemented method comprising:

in response to determining that a first window of audio data does not contain a low frequency transient signal, computing a first group of masking thresholds for a first long block that corresponds to the first window of audio data; and based on said first group of masking thresholds, encoding said first long block of audio data;

in response to identifying a low frequency transient signal in a second window of digital audio samples, computing a second group of masking thresholds for a second long block that corresponds to the second window of audio samples;

computing a third group of masking thresholds for short blocks corresponding to the second window of audio samples;

selecting a final masking threshold that is between (a) one or more particular masking thresholds from the third group of masking thresholds and (b) one or more particular masking thresholds from the second group of masking thresholds; and based on said final masking threshold, encoding by a coder the second long block that corresponds to the window of audio samples;

wherein the computer-implemented method is performed by one or more computing devices.

* * * * *

UNITED STATES PATENT AND TRADEMARK OFFICE

CERTIFICATE OF CORRECTION

PATENT NO. : 7,627,481 B1
APPLICATION NO. : 11/110331
DATED : December 1, 2009
INVENTOR(S) : Kuo et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1049 days.

Signed and Sealed this

Second Day of November, 2010

David J. Kappos

David J. Kappos
*Director of the United States Patent and Trademark Office*